US009101953B2

(12) United States Patent
Peleg et al.

(10) Patent No.: US 9,101,953 B2
(45) Date of Patent: Aug. 11, 2015

(54) COATING APPARATUS

(75) Inventors: Eyal Peleg, Zoran (IL); Doron Schlumm, Kfar Harif (IL); Benji Ruhm, Tel-Aviv (IL)

(73) Assignee: Hewlett-Packard Indigo B.V., Maastricht (NL)

( * ) Notice: Subject to any disclaimer, the term of this patent is extended or adjusted under 35 U.S.C. 154(b) by 93 days.

(21) Appl. No.: 13/555,618

(22) Filed: Jul. 23, 2012

(65) Prior Publication Data

US 2014/0023791 A1 Jan. 23, 2014

(51) Int. Cl.

| | |
|---|---|
| ***B05C 1/00*** | (2006.01) |
| ***B05C 1/08*** | (2006.01) |
| ***B05C 1/04*** | (2006.01) |
| ***B41J 11/00*** | (2006.01) |
| ***B05C 11/10*** | (2006.01) |
| *B05D 1/28* | (2006.01) |
| *B05D 1/02* | (2006.01) |

(52) U.S. Cl.

CPC ..... *B05C 1/0813* (2013.01); *B05C 1/04* (2013.01); *B05C 1/08* (2013.01); *B05C 11/1002* (2013.01); *B41J 11/0015* (2013.01); *B05D 1/02* (2013.01); *B05D 1/28* (2013.01)

(58) Field of Classification Search

CPC ..... B05C 1/00; B05C 1/04; B05C 1/08; B05C 11/00; G03G 15/169; G03G 2215/1666; B41F 7/30; B41F 7/26; B41F 33/0054; B41F 23/00; B41J 11/0015

USPC ..... 101/147, 148, 484; 347/1, 2, 4–6, 9–13, 347/16, 103; 118/679–684, 696, 300, 304

See application file for complete search history.

(56) References Cited

U.S. PATENT DOCUMENTS

| | | | | |
|---|---|---|---|---|
| 4,066,017 | A * | 1/1978 | Garcowski et al. | 101/425 |
| 5,038,681 | A * | 8/1991 | Hultberg et al. | 101/484 |
| 5,216,952 | A * | 6/1993 | Hoff et al. | 101/148 |
| 5,460,023 | A * | 10/1995 | Ginzburg | 72/43 |
| 6,279,474 | B1 * | 8/2001 | Liebl | 101/351.8 |
| 6,955,721 | B2 | 10/2005 | Baker | |
| 7,845,783 | B2 | 12/2010 | Gervasi | |
| 2007/0044670 | A1 * | 3/2007 | Blaney et al. | 101/148 |
| 2010/0173077 | A1 | 7/2010 | Ming | |
| 2010/0196603 | A1 * | 8/2010 | Ohshima et al. | 427/288 |
| 2012/0019587 | A1 | 1/2012 | Koenig | |

FOREIGN PATENT DOCUMENTS

| | | |
|---|---|---|
| CN | 201099050 | 8/2008 |

OTHER PUBLICATIONS

Henrik Andersson et al., Evaluation of Coatings Applied to Flexible Substrates to Enhance Quality of Ink Jet Printed Silver Nano-Particle Structures, IEEE Transactions on Components, Packaging and Manufacturing Technology, vol. 2, No. 2, February 2012 (7 pages).

* cited by examiner

*Primary Examiner* — Laura Edwards

(57) ABSTRACT

Coating apparatus including a spray to provide a coating, a controller to control the spray to vary a spraying width of the spray, and a first roller to receive the coating and to smear the coating on a substrate.

9 Claims, 5 Drawing Sheets

COATING APPARATUS

BACKGROUND

Coating apparatus may be used to apply a layer of primer on a substrate (such as paper) prior to the deposition of ink on the substrate. The primer may improve the fixing of the ink to the substrate and thereby improve the quality of printed text and/or images on the substrate. Coating apparatus may also be used to apply a layer of post-treatment coating on a substrate after the deposition of ink on the substrate. However, such coating apparatus may be unable to apply a coating to substrates having differing dimensions. Additionally, such coating apparatus may apply a relatively thick layer of coating to the substrate that may increase the cost of operation of the coating apparatus and may result in a relatively long drying time for the coating on the substrate.

BRIEF DESCRIPTION

Reference will now be made by way of example only to the accompanying drawings in which.

DETAILED DESCRIPTION

In the following description and figures, the wording 'connect' and 'couple' and their derivatives mean operationally connected or coupled. It should be appreciated that any number or combination of intervening components can exist (including no intervening components).

Figure 1:
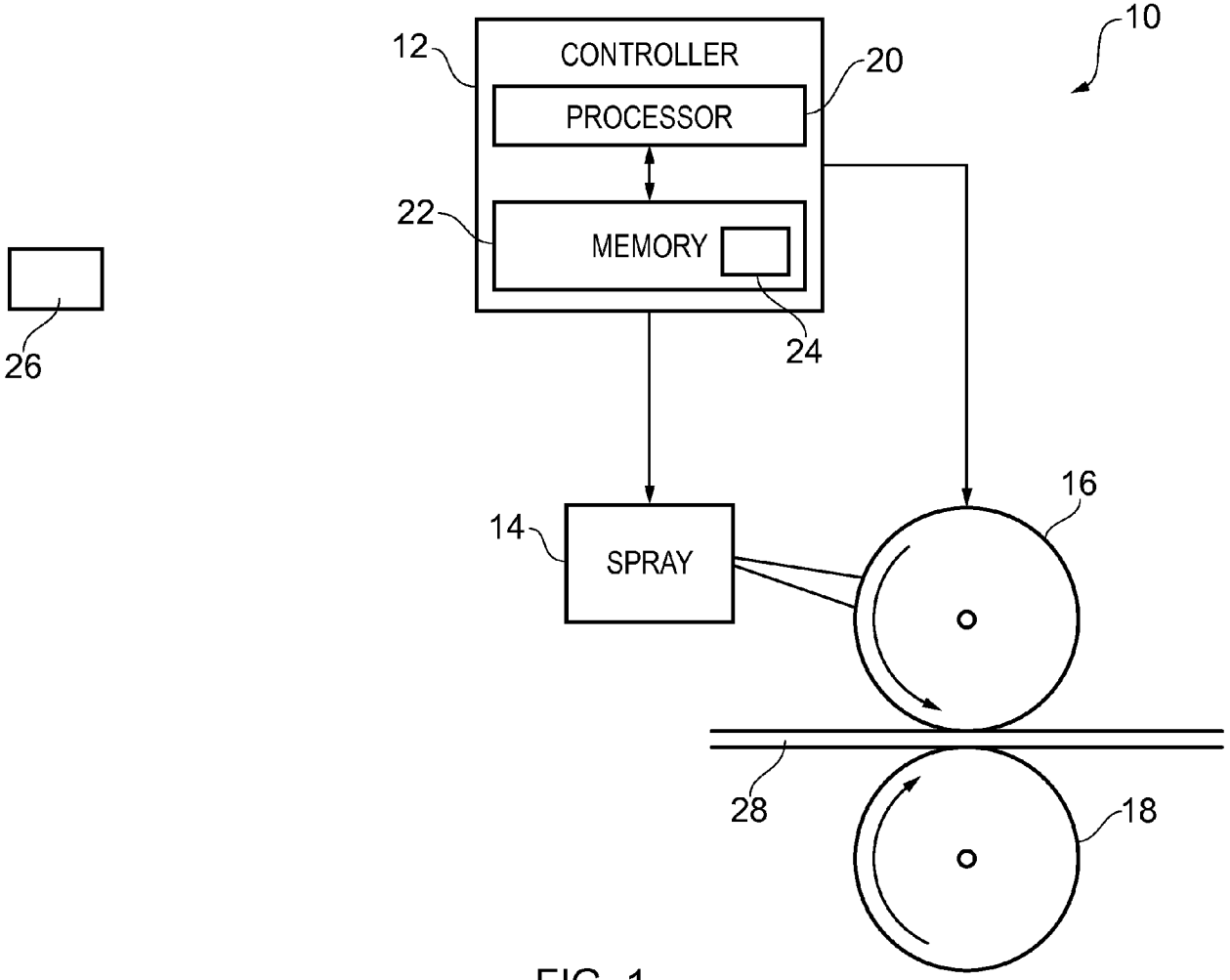
FIG. 1 illustrates a schematic side view diagram of a coating apparatus according to an example.

FIG. 1 illustrates a schematic side view diagram of a coating apparatus 10 including a controller 12, a spray 14, a roller 16 and a nip roller 18. The coating apparatus 10 may be an integral part of a printing device or may be a module of such a printing device (where 'module' refers to a unit or apparatus that excludes certain parts/components that would be added by an end manufacturer or a user). For example, the coating apparatus 10 may be a priming apparatus and form a first stage of the printing device and printing apparatus (that deposits ink on the substrate) may form a second stage of the printing device. By way of another example, the coating apparatus 10 may be an apparatus for applying a post treatment coating (such as liquid varnish) and form a second stage of the printing device and printing apparatus (that deposits ink on the substrate) may form a first stage of the printing device. In other examples, the coating apparatus 10 may be a separate standalone device and is therefore not included within a printing device.

The implementation of the controller 12 can be in hardware alone (for example, a circuit, a processor and so on), have certain aspects in software including firmware alone or can be a combination of hardware and software (including firmware).

The controller 12 may be implemented using instructions that enable hardware functionality, for example, by using executable computer program instructions in a general-purpose or special-purpose processor 20 that may be stored on a computer readable storage medium 22 (disk, memory etc) to be executed by such a processor 20.

The processor 20 is configured to read from and write to the memory 22. The processor 20 may also comprise an output interface via which data and/or commands are output by the processor 20 and an input interface via which data and/or commands are input to the processor 20.

The memory 22 stores a computer program 24 comprising computer program instructions that control the operation of the coating apparatus 10 when loaded into the processor 20. The computer program instructions 24 provide the logic and routines that enables the coating apparatus 10 to perform the method illustrated in FIG. 3. The processor 20 by reading the memory 22 is able to load and execute the computer program 24.

The computer program 24 may arrive at the coating apparatus 10 via any suitable delivery mechanism 26. The delivery mechanism 26 may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 24. The delivery mechanism 26 may be a signal configured to reliably transfer the computer program 24. The coating apparatus 10 may propagate or transmit the computer program 24 as a computer data signal.

Although the memory 22 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analogue and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware.

The spray 14 may be any suitable spray apparatus for spraying a coating (such as primer or a post treatment coating such as liquid varnish) and may include at least one inkjet (for example, the at least one inkjet may include piezo electric inkjets (PIJ) and/or thermal inkjets (TIJ)). In some embodiments, the spray 14 may include a plurality of sprays that are arranged similarly to inkjet heads. The controller 12 is arranged to control the operation of the spray 14 and this is described in more detail in the following paragraphs.

The roller 16 is positioned adjacent the spray 14 and is arranged to receive the coating sprayed from the spray 14. The controller 12 is arranged to control the roller 16 to rotate in an anti-clockwise direction to smear the coating on to a substrate 28. In some examples, the roller 16 includes an exterior rubber surface that may advantageously enable the roller 16 to transfer coating to relatively rugged media.

The nip roller 18 is positioned adjacent the roller 16 and forms a nip through which the substrate 28 may pass and receive coating from the roller 16. As illustrated in FIG. 1, the nip roller 18 is arranged to rotate in a clockwise direction and the rotation of the nip roller 18 may be controlled by the controller 12 in some examples.

The substrate 28 may be a sheet of printing media (for example, a sheet of A4 paper) or may be a continuous length of printing media which is cut to size after being processed by the coating apparatus 10. The substrate 28 may comprise any materials and may comprise paper for example.

Figure 2:
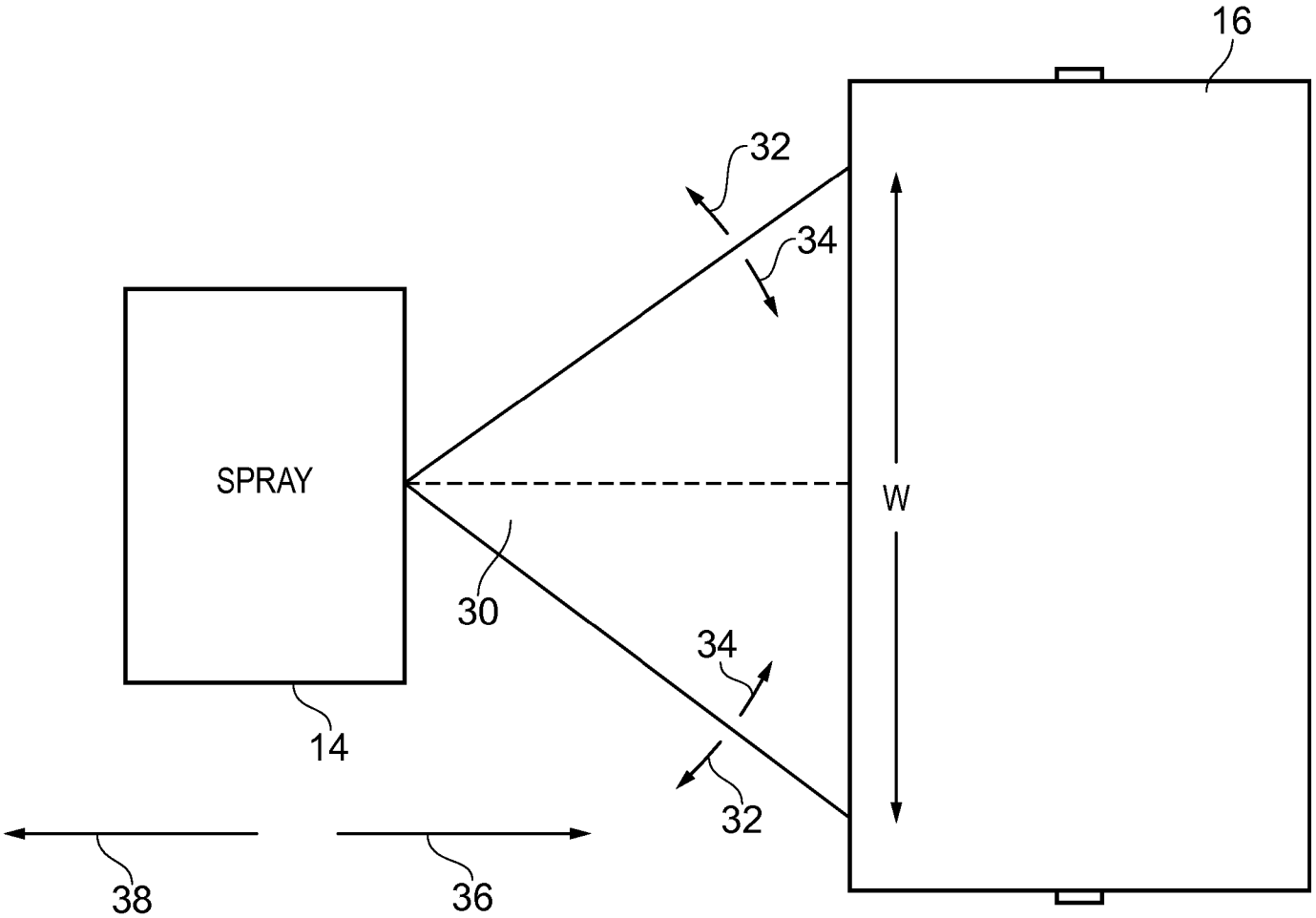
FIG. 2 illustrates a schematic plan view diagram of the spray and roller of the coating apparatus illustrated in FIG. 1.

FIG. 2 illustrates a schematic plan view diagram of the spray 14 and the roller 16 illustrated in FIG. 1 in operation. As illustrated, the spray 14 may spray a coating 30 onto the surface of the roller 16 and the sprayed coating 30 may have a triangular shape when viewed in plan.

The controller 12 is arranged to control the spray 14 to vary a spraying width W of the spray 14. In some examples, the controller 12 may control the spray 14 by varying at least one nozzle shape of the spray 14. For example, the controller 12 may adjust a spray nozzle to increase the spraying width W so that edges of the sprayed coating 30 move in the direction indicated by arrows 32 (i.e. outwards). By way of another example, the controller 12 may adjust a spray nozzle to decrease the spraying width W so that the edges of the sprayed coating move in the direction indicated by arrows 34 (i.e. inwards).

In other examples, the controller 12 may control the variation of the spraying width of the spray 14 by moving the spray 14 towards and away from the roller 16. As the spray 14 moves towards the roller 16 in the direction of arrow 36, the spraying width W at the roller 16 decreases. As the spray 14 moves away from the roller 16 in the direction of arrow 38, the spraying width W at the roller 16 increases.

In further examples, the spray 14 may include a row of spray units that spray coating in a direction that is perpendicular to the surface of the roller 16. In these examples, the controller 12 may control the variation of the spraying width by spraying from differently sized subsets of spray units. For example, where a large spray width is desired, the controller 12 may control the spray 14 so that all of the spray units spray a coating. Where a smaller spray width is desired, the controller 12 may control the spray 14 so that a subset of the spray units spray a coating.

The variation in the spraying width W of the spray 14 provides an advantage in that coating may be provided across a selected width of the roller 16 (and consequently, across a selected width of the substrate 28). This may reduce the cost of operating the coating apparatus 10 since coating is not provided to areas that do not require coating (for example, the margins of the substrate may not require a primer for printing).

Additionally, the variation in the spraying width W of the spray 14 provides an advantage in that the controller 12 may control the spraying width W to correspond to a width of a substrate 28. For example, where a substrate has a width of 21 cm, the spraying width may be set to 21 cm or less. By way of another example, where a substrate has a width of 30 cm, the spraying width may be set to 30 cm or less. The controller 12 may control the spraying width in response to a user input indicating the width of the substrate 28 or in response to an input signal from a sensor indicating the width of the substrate 28.

Furthermore, the variation in the spraying width W of the spray 14 provides an advantage in that since the controller 12 may control the spraying width W to be equal to or less than the width of the substrate 28, the roller 16 may transfer little to no coating to the nip roller 18. Consequently, the coating apparatus 10 may use the coating relatively efficiently and the nip roller 18 may not require frequent cleaning.

In some examples, the controller 12 is arranged to control the spray 14 to provide a coating for a time period that is sufficient to enable the coating apparatus 10 to apply coating within a length of a sheet of substrate 28. In more detail, where it is desired to provide coating to fit within a length of the substrate 28, the controller 12 controls the spray 14 to provide the coating so that the coating is applied to the desired starting point on the substrate 28, and controls the spray 14 to stop spraying the coating after a period of time so that the coating is not applied after the desired ending point on the substrate 28. The controller 12 may control the spray 14 to provide the coating for a time period using an input signal from a user input device or from a sensor that indicates the length of a substrate sheet.

In some examples, the controller 12 is arranged to control the spray 14 to vary the rate at which the coating is provided by the spray 14 in dependence on the material of a substrate 28. For example, where the coating apparatus 10 is a priming apparatus, the controller 12 may receive an input signal from a user input device or from a sensor that indicates the material of the substrate 28. Where the material of the substrate 28 is relatively thick and absorptive, the controller 12 may control the spray 14 to spray primer at a relatively high rate, and where the material of the substrate 28 is relatively thin and non-absorptive, the controller 12 may control the spray 14 to spray primer at relatively low rate.

In some examples, the controller 12 is arranged to control the spray 14 to vary the spraying width and/or time period for providing the coating in dependence on an image to be printed. For example, the controller 12 may determine that an image is to be printed on the substrate 28 in a first area. The controller 12 may then control the spray 14 to provide a coating to the roller 16 so that the coating is smeared on the first area of the substrate 28 (i.e. the width, time duration, and location of the sprayed coating is selected so that the coating is smeared on the first area of the substrate 28).

Figure 3:
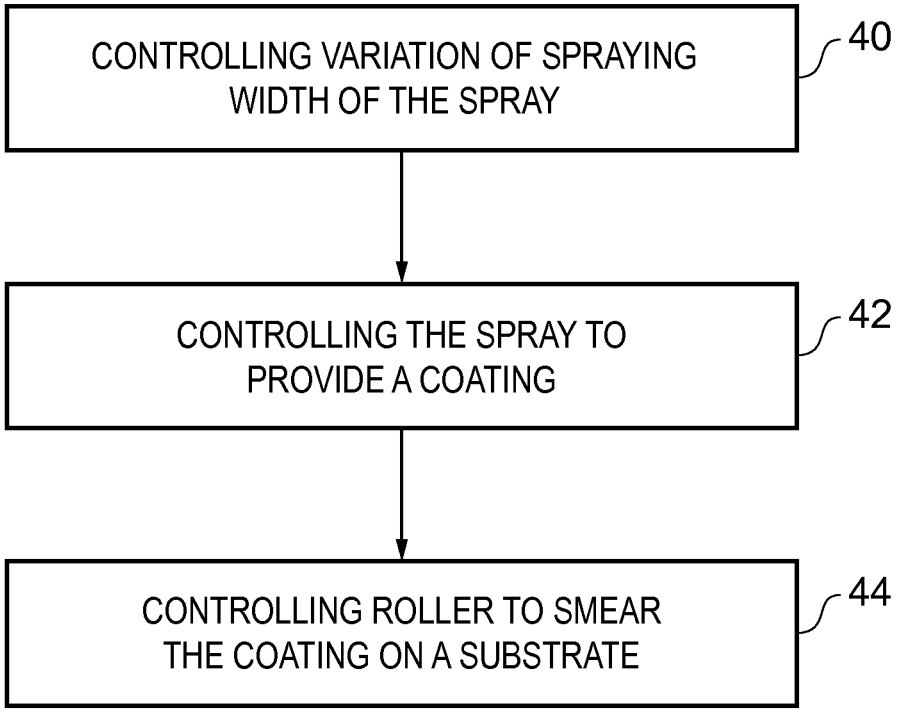
FIG. 3 illustrates a flow diagram of a method of operation according to an example.

FIG. 3 illustrates a flow diagram of a method of operation for the coating apparatus 10 illustrated in FIGS. 1 and 2.

At block 40, the method includes controlling variation of spraying width of the spray 14. For example, the controller 12 may control the spray 14 to have a spraying width W that corresponds to the width of the substrate 28, or to the width of an image to be printed on the substrate 28.

At block 42, the method includes controlling the spray 14 to spray a coating. For example, the controller 12 may control the spray 14 to commence spraying at a particular time and for a particular duration that results in a coating being transferred from the roller 16 within the edges of a sheet of substrate. By way of another example, the controller 12 may control the spray 14 to spray a coating at a particular rate depending on the material of the substrate 28.

At block 44, the method includes controlling the roller 16 to smear the coating on the substrate 28.

The blocks illustrated in FIG. 3 may be performed in a different order to that illustrated. For example, the controller 12 may perform block 40 at any point in time to vary the spraying width of the spray 14 (e.g. in response to a change in the width of substrate being processed).

Figure 4:
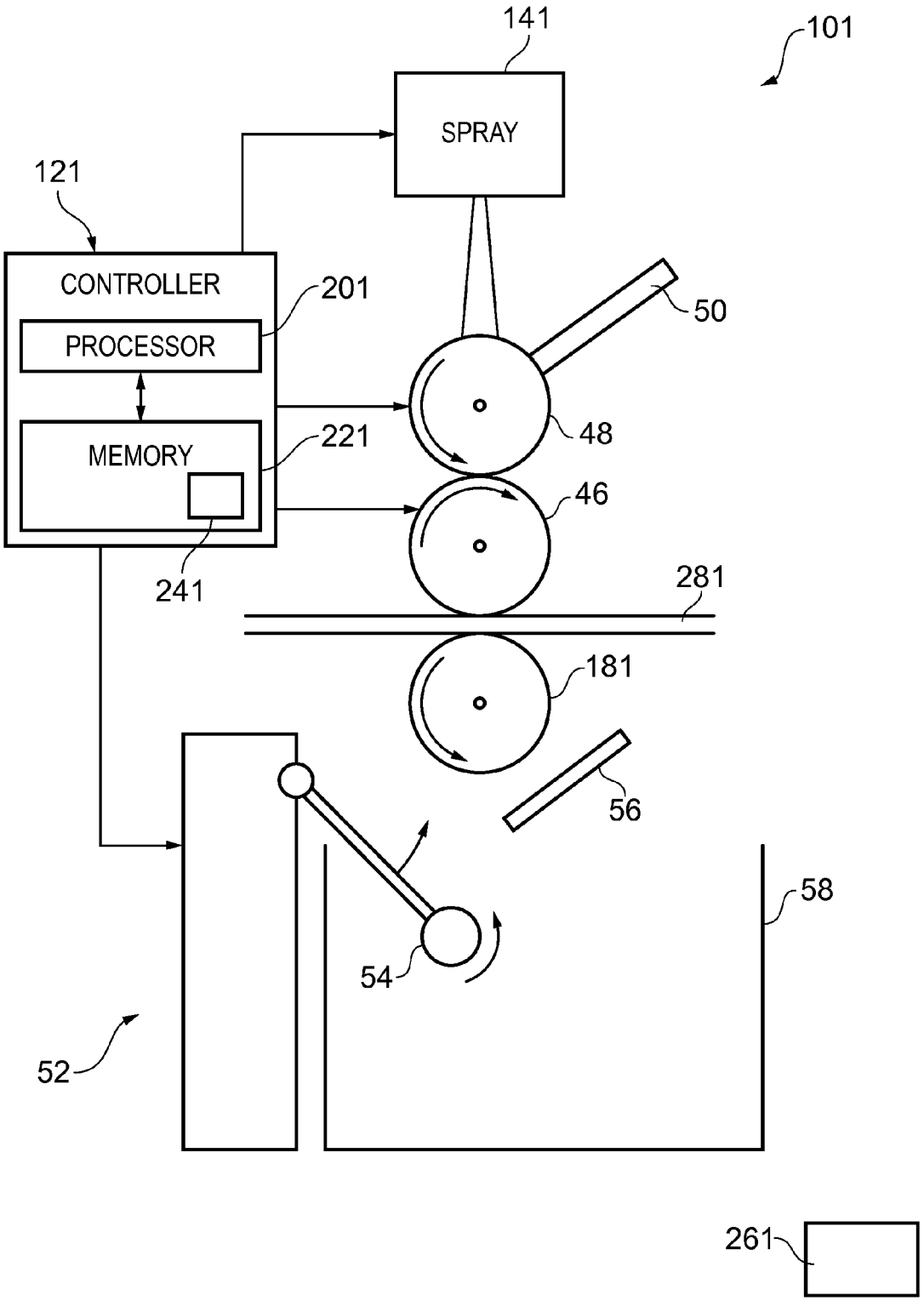
FIG. 4 illustrates a schematic diagram of another coating apparatus according to an example.

FIG. 4 illustrates a schematic diagram of another coating apparatus 101 according to an example. The coating apparatus 101 is similar to the coating apparatus 10 illustrated in FIG. 1 and where the features are similar, the same reference numerals are used with the addition of a '1' at their end. Consequently, the coating apparatus 101 includes a controller 121 (comprising a processor 201 and a memory 221 storing a computer program 241), a spray 141 and a nip roller 181. The memory 221 stores a computer program 241 comprising computer program instructions that control the operation of the coating apparatus 101 when loaded into the processor 201. The computer program instructions 241 provide the logic and routines that enables the coating apparatus 101 to perform the method illustrated in FIG. 5. The processor 201 by reading the memory 221 is able to load and execute the computer program 241.

The coating apparatus 101 differs from the coating apparatus 10 in that the coating apparatus 101 includes a first roller 46, a second roller 48, a first cleaning blade 50, a cleaning apparatus 52 including a cleaning roller 54, a second cleaning blade 56 and a receptacle 58.

The second roller 48 is positioned adjacent the spray 141 and is arranged to receive a coating from the spray 141. The controller 121 is arranged to control the second roller 48 to rotate in an anti-clockwise direction. In some embodiments, the controller 121 may be arranged to control the velocity at which the second roller 48 rotates.

The first roller 46 is positioned adjacent the second roller 48 and is arranged to receive coating from the second roller 48 (that is, the second roller 48 smears the coating on the first roller 46). The controller 121 is arranged to control the first roller 46 to rotate in a clockwise direction so that at the nip between the first roller 46 and the second roller 48, the surfaces of the first and second rollers 46, 48 move in the same direction. In some embodiments, the controller 121 may be arranged to control the velocity at which the first roller 46 rotates. The first roller 46 may have an exterior rubber surface in some embodiments.

The thickness of the coating transferred from the second roller 48 to the first roller 46 is a function of the relative velocities between the first and second rollers 46, 48. In particular, the thickness of the coating transferred is proportional to the relative velocity between the first and second rollers 46, 48. The controller 12 is arranged to control the velocities of the first and second rollers 46, 48 so that a desired thickness of the coating is transferred to the substrate 281. For example, the controller 12 may control the velocities so that the thickness of the coating transferred to the substrate 281 is suitable for the material of the substrate 281.

By way of an example, where the gap between the first and second rollers 46, 48 is 200 microns: a thickness of 0 microns of coating is transferred when the relative velocity between the first and second rollers 46, 48 is 0 metres per second; a thickness of 1.4 microns of coating is transferred when the relative velocity between the first and second rollers 46, 48 is 0.05 metres per second; a thickness of 2.8 microns of coating is transferred when the relative velocity between the first and second rollers 46, 48 is 0.1 metres per second; and a thickness of 4.2 microns of coating is transferred when the relative velocity between the first and second rollers 46, 48 is 0.15 metres per second.

The thickness of coating transferred from the second roller 48 to the first roller 46 is a function of the size of the gap between the first and second rollers 46, 48. In particular, the thickness of coating transferred increases as the gap between the first and second rollers 46, 48 increases. The controller 121 may be arranged to control the gap between the first and second rollers 46, 48 so that a desired thickness of coating is transferred to the substrate 281 (that is, the controller 121 may be arranged to control the position of the first roller 46 and/or the position of the second roller 48 to obtain a desired gap size). For example, the controller 121 may control the size of the gap so that the thickness of coating transferred to the substrate 281 is suitable for the material of the substrate 281.

By way of an example, where the relative velocity between the first and second rollers 46, 48 is 0.25 metres per second: a thickness of 1.8 microns of coating is transferred when the gap between the first and second rollers 46, 48 is 50 microns; a thickness of 5 microns of coating is transferred when the gap between the first and second rollers 46, 48 is 150 microns; and a thickness of 7 microns of coating is transferred when the gap between the first and second rollers 46, 48 is 200 microns.

The first cleaning blade 50 is positioned adjacent the second roller 48 and is arranged to remove coating from the second roller 48 not transferred to the first roller 46.

The cleaning apparatus 52 is positioned adjacent the nip roller 181 and the cleaning roller 54 is arranged to pivot between a first position in which the cleaning roller 54 contacts the nip roller 181 and a second position in which the cleaning roller 54 is removed from the nip roller 181 (i.e. the cleaning roller 54 and the nip roller 181 are physically spaced apart from one another and therefore do not touch). The cleaning roller 54 is arranged to rotate in an anti-clockwise direction. The controller 121 is arranged to control the movement and rotation of the cleaning roller 54.

The second cleaning blade 56 is positioned so that when the cleaning roller 54 is at the first position (i.e. where the cleaning roller 54 contacts the nip roller 181), the second cleaning blade 56 contacts the cleaning roller 54 and removes coating from the cleaning roller 54.

The receptacle 58 is positioned underneath the second cleaning blade 56 and is arranged to receive coating removed from the cleaning roller 54 by the second cleaning blade 56. The coating received by the receptacle 58 may be recycled and pumped to the spray 141 for re-use.

Figure 5:
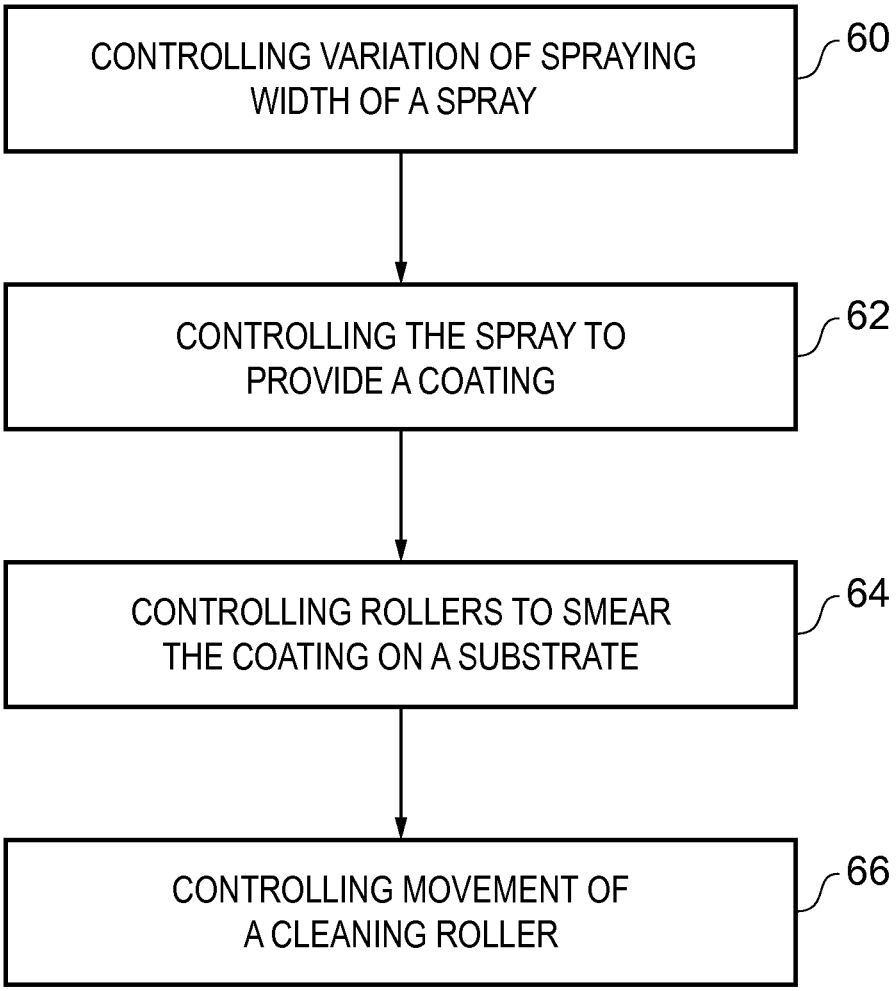
FIG. 5 illustrates a flow diagram of another method of operation according to an example.

FIG. 5 illustrates a flow diagram of a method of operation for the coating apparatus 101 illustrated in FIGS. 1 and 2.

At block 60, the method includes controlling variation of spraying width of the spray 141. For example, the controller 121 may control the spray 141 to have a spraying width W that corresponds to the width of the substrate 281, or to the width of an image to be printed on the substrate 281.

At block 62, the method includes controlling the spray 141 to spray a coating on the second roller 48. For example, the controller 121 may control the spray 141 to commence spraying at a particular time and for a particular duration that results in coating being transferred from the first roller 46 within the edges of a sheet of substrate. By way of another example, the controller 121 may control the spray 141 to spray coating at a particular rate depending on the material of the substrate 281.

At block 64, the method includes controlling the first and second rollers 46, 48 to smear the coating on the substrate 281. For example, the controller 121 may control the relative velocities of the first and second rollers 46, 48 and/or the size of the gap between the first and second rollers 46, 48 to provide a desired thickness of coating to the substrate 281.

At block 66, the method includes controlling movement of the cleaning roller 54 to clean the nip roller 181. For example, the controller may move the cleaning roller 54 into contact with the nip roller 181 in response to controlling the spray 141 to spray coating on the second roller 48.

The blocks illustrated in FIG. 5 may be performed in a different order to that illustrated. For example, the controller 121 may perform block 60 at any point in time to vary the spraying width of the spray 141 (e.g. in response to a change in the width of substrate being processed).

The coating apparatus 101 provides an advantage in that the first and second rollers 46, 48 enable the coating to be smeared on the substrate 281 at a desired thickness. This may help to reduce the cost of operating the coating apparatus 101 (since less coating is used on the substrate 281) and may reduce the drying time for the coating on the substrate 281. Additionally, the smearing of coating by the first and second rollers 46, 48 may increase the uniformity of the coating on the substrate 281.

The blocks illustrated in the FIGS. 3 and 5 may represent steps in a method and/or sections of code in the computer program 24, 241. The illustration of a particular order to the blocks does not necessarily imply that there is a required or preferred order for the blocks and the order and arrangement of the block may be varied. Furthermore, it may be possible for some blocks to be omitted.

Although examples of the present invention have been described in the preceding paragraphs, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain examples, those features may also be present in other examples whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A coating apparatus comprising:

a spray unit to spray a coating;

a controller configured to:

receive input information relating to a width and length associated with a substrate, vary, based on the received input information relating to the width and length associated with the substrate, a spraying width and timing of the sprayed coating;

receive input information relating to a material of the substrate, and vary a rate at which the sprayed coating is provided by the spray unit in dependence on the material of the substrate, wherein varying the rate comprises:

setting a first rate at which the sprayed coating is provided by the spray unit in response to the input information relating to the material of the substrate specifying that the material is a first material; and setting a second rate at which the sprayed coating is provided by the spray unit in response to the input information relating to the material of the substrate specifying that the material is a second material, where the second material is different from the first material, and where the second rate is different from the first rate;

a first roller to receive the coating and to apply the coating on the substrate; and a nip roller to pass the substrate.

2. The coating apparatus as claimed in claim 1, further comprising a second roller arranged to receive the coating from the spray unit and to transfer the coating to the first roller, wherein the first roller and the second roller are arranged to rotate at different velocities.

3. The coating apparatus as claimed in claim 1, wherein the controller is configured to vary the timing by varying a time period of spraying of the coating by the spray unit according to the length, the spray unit to commence spraying the coating at the start of the time period and stop spraying the coating at the end of the time period.

4. The coating apparatus as claimed in claim 1, wherein the received input information relating to the width includes a width of an image to be printed on the substrate, and the controller is configured to vary the spraying width for providing the coating to a portion of the substrate in dependence on the width of the image to be printed on the portion of the substrate.

5. The coating apparatus as claimed in claim 1, further comprising:

a cleaning roller arranged to clean the nip roller, the cleaning roller being moveable between a position in which the cleaning roller contacts the nip roller and a position in which the cleaning roller is removed from the nip roller.

6. The coating apparatus as claimed in claim 1, wherein the spray unit includes an inkjet nozzle.

7. The coating apparatus as claimed in claim 1, wherein the controller is configured to control the spraying width and the timing of the sprayed coating to apply the coating on the substrate such that the applied coating has a target width and length.

8. The coating apparatus as claimed in claim 2, wherein the controller is configured to further:

receive information relating to a target thickness of the coating on the substrate; and control the velocities of the first and second rollers based on the target thickness.

9. The coating apparatus as claimed in claim 1, wherein the nip roller is positioned adjacent the first roller, the nip roller to form a nip through which the substrate passes.

* * * * *